US006422481B2

(12) United States Patent
Ren et al.

(10) Patent No.: US 6,422,481 B2
(45) **Date of Patent: *Jul. 23, 2002**

(54) METHOD OF ENHANCING HEAT TRANSFER IN A HEATED TIP FUEL INJECTOR

(75) Inventors: Wei-Min Ren, Yorktown; Frank Zimmermann, Newport News; John F. Nally, Jr., Williamsburg; John Bright, Newport News, all of VA (US)

(73) Assignee: Siemens Automotive Corporation, Auburn Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/261,408

(22) Filed: Mar. 3, 1999

Related U.S. Application Data

(63) Continuation-in-part of application No. 09/088,126, filed on Jun. 1, 1998, now Pat. No. 6,109,543, and a continuation-in-part of application No. 09/088,127, filed on Jun. 1, 1998, now Pat. No. 6,102,303.

(51) Int. Cl.[7] ..... B05B 1/24

(52) U.S. Cl. ..... 239/13; 239/135; 239/585.1

(58) Field of Search ..... 239/1, 5, 13, 128, 239/135, 136, 139, 461, 463, 533.1, 533.2, 533.9, 533.12, 533.15, 533.14, 569, 583, 584, 585.1, 585.4, 585.5, 601, 466, 472, 494, 496, 497, 554, 555, 540; 251/129.21; 137/341; 123/549, 557, 558; 219/541, 205, 270

(56) References Cited

U.S. PATENT DOCUMENTS

| | | | | |
|---|---|---|---|---|
| 3,868,939 | A | 3/1975 | Hermann et al. | 123/179 L |
| 3,876,861 | A | 4/1975 | Wightman et al. | 219/463 |
| 3,927,300 | A | 12/1975 | Wada et al. | 219/381 |
| 4,032,752 | A | 6/1977 | Ohmura et al. | 219/541 |
| 4,279,234 | A | 7/1981 | Marcoux et al. | 123/549 |
| 4,447,706 | A | 5/1984 | Eder et al. | 219/299 |
| 4,458,655 | A | 7/1984 | Oza | 123/558 |
| 4,572,146 | A | 2/1986 | Grunwald et al. | 123/549 |
| 4,622,069 | A | 11/1986 | Berg et al. | 219/553 |
| 4,627,405 | A | 12/1986 | Imhof et al. | 123/549 |
| 4,713,524 | A | 12/1987 | Leo et al. | 219/307 |
| 4,760,818 | A | 8/1988 | Brooks et al. | 123/298 |
| 4,834,043 | A | 5/1989 | Kaczynski et al. | 123/549 |
| 4,870,249 | A | 9/1989 | Kayanuma et al. | 219/206 |
| 4,870,943 | A | 10/1989 | Bradley | |
| 4,898,142 | A | 2/1990 | Van Wechem et al. | 123/557 |
| 5,056,495 | A | 10/1991 | Yamashita | 123/549 |
| 5,114,077 | A | 5/1992 | Cerny | 239/483 |
| 5,218,943 | A | 6/1993 | Takeda et al. | 123/531 |
| 5,361,990 | A | 11/1994 | Pimentel | 239/133 |
| 5,389,195 | A | 2/1995 | Ouderkirk et al. | 156/643 |

(List continued on next page.)

FOREIGN PATENT DOCUMENTS

| | | | |
|---|---|---|---|
| DE | 19812 092 A 1 | 9/1998 | F02M/51/06 |
| WO | WO 92/10011 | 6/1992 | |
| WO | WO 96/30644 | 10/1996 | |
| WO | WO 99/05412 | * 7/1998 | |

OTHER PUBLICATIONS

Patent Abstracts of Japan, vol. 107, No. 241 (E–1364, May 14, 1993 and JP 04 366585 A (Nippondenso Co., Ltd.), Dec. 18, 1992.

*Primary Examiner*—Lisa Ann Douglas

(57) ABSTRACT

A method of heating fuel includes providing a fuel injector having an internal heater and a reciprocable needle valve; providing fuel to the fuel injector; passing the fuel through at least one flow-disturbing element; and heating the fuel.

19 Claims, 4 Drawing Sheets

U.S. PATENT DOCUMENTS

| | | | | |
|---|---|---|---|---|
| 5,400,969 | A | | 3/1995 | Keene ..... 219/205 |
| 5,401,935 | A | | 3/1995 | Smith et al. ..... 219/206 |
| 5,609,297 | A | | 3/1997 | Gladigow et al. ..... 239/135 |
| 5,634,597 | A | | 6/1997 | Krohn et al. ..... 239/585.1 |
| 5,642,862 | A | | 7/1997 | Wakeman et al. ..... 239/585.4 |
| 5,758,826 | A | | 6/1998 | Nines ..... 239/136 |
| 5,765,750 | A | * | 6/1998 | Pace et al. ..... 239/5 |
| 5,836,289 | A | | 11/1998 | Thring ..... 123/549 |
| 5,915,626 | A | * | 6/1999 | Awarzamani et al. ..... 239/135 |

* cited by examiner

METHOD OF ENHANCING HEAT TRANSFER IN A HEATED TIP FUEL INJECTOR

This application is a continuation-in-part of applications Ser. No. 09/088,126 entitled "Method of Preheating Fuel With an Internal Heater," filed on Jun. 1, 1998, now U.S. Pat. No. 6,109,543 which is expressly incorporated by reference herein and Ser. No. 09/088,127 now U.S. Pat. No. 6,102,303 entitled "Fuel Injector With Internal Heater," now U.S. Pat. No. 6,102,303, filed on Jun. 1, 1998 which is also expressly incorporated by reference herein.

BACKGROUND OF THE INVENTION

The invention relates in general to heated tip fuel injectors with internal heaters and, in particular, to a method of enhancing heat transfer from the internal heater to the fuel in a heated tip fuel injector.

It has been recognized that preheating of the fuel during cold starting will reduce hydrocarbon emissions caused by incomplete fuel vaporization during cold starts. Heated tip fuel injectors are known and described in, for example, copending applications Ser. Nos. 09/088,126 now U.S. Pat. No. 6,109,543 and Ser. No. 09/088,127 now U.S. Pat. No. 6,102,303 referenced above. While those patent applications generally describe enhancing the heat transfer from the heater to the fuel, more efficient heat transfer mechanisms and methods are needed to further reduce emissions.

SUMMARY OF THE INVENTION

It is an object of the present invention to provide a method of enhancing heat transfer from the internal heater to the fuel in a heated tip fuel injector.

This and other objects of the invention are achieved by a method of heating fuel comprising providing a fuel injector having an internal heater and a reciprocable needle valve; providing fuel to the fuel injector; passing the fuel through at least one flow-disturbing element; and heating the fuel.

The method further comprises exiting the fuel from the fuel injector.

In one embodiment of the inventive method, the at least one flow disturbing element reciprocates with the needle valve.

In another embodiment of the inventive method, the at least one flow disturbing element is stationary with respect to the needle valve.

In a broad aspect, the passing step includes passing the fuel through a first opening in the flow disturbing element and then passing the fuel through a second opening in the flow disturbing element wherein the second opening is offset from the first opening.

Preferably, the passing step includes passing the fuel through a first plurality of openings in the flow disturbing element and then passing the fuel through a second plurality of openings in the flow disturbing element.

In a preferred embodiment, the first plurality of openings are offset from the second plurality of openings such that, when viewed in a longitudinal direction of the injector, there is substantially no overlap between the first and second plurality of openings.

More preferably, the passing step includes passing the fuel through a first pair of opposed openings in a first disk, through an opening in a second disk, and then through second and third pairs of opposed openings in a third disk.

Most preferably, when viewed in a longitudinal direction of the fuel injector, the first pair of opposed openings in the first disk do not substantially overlap the second and third pair of opposed openings in the third disk.

In another aspect of the method of the invention, the passing step includes creating a swirl flow component in the fuel. Preferably, the step of creating a swirl component includes creating a circumferential flow component in the fuel by directing the fuel through at least one arc-shaped opening in the flow-disturbing element. Most preferably, the step of creating a circumferential flow component in the fuel includes directing the fuel through six arc-shaped openings in the flow-disturbing element.

In one embodiment, the step of directing the fuel includes directing the fuel in one direction through three of the arc-shaped openings and directing the fuel in an opposite direction through the other three of the arc-shaped openings.

Preferably, three of the arc-shaped openings are substantially equal in size and spaced substantially uniformly in the flow disturbing element and the other three arc-shaped openings are substantially equal in size and spaced substantially uniformly in the flow disturbing element.

More preferably, three of the arc-shaped openings are located further from a center of the flow-disturbing element than the other three arc-shaped openings.

In one embodiment, when the needle valve reciprocates to a closed position, the flow-disturbing element rests substantially on a top of the internal heater. In another embodiment, when the needle valve reciprocates to a closed position, there is a gap between the flow disturbing element and a top of the internal heater.

DETAILED DESCRIPTION OF THE PREFERRED EMBODIMENTS

Figure 1:
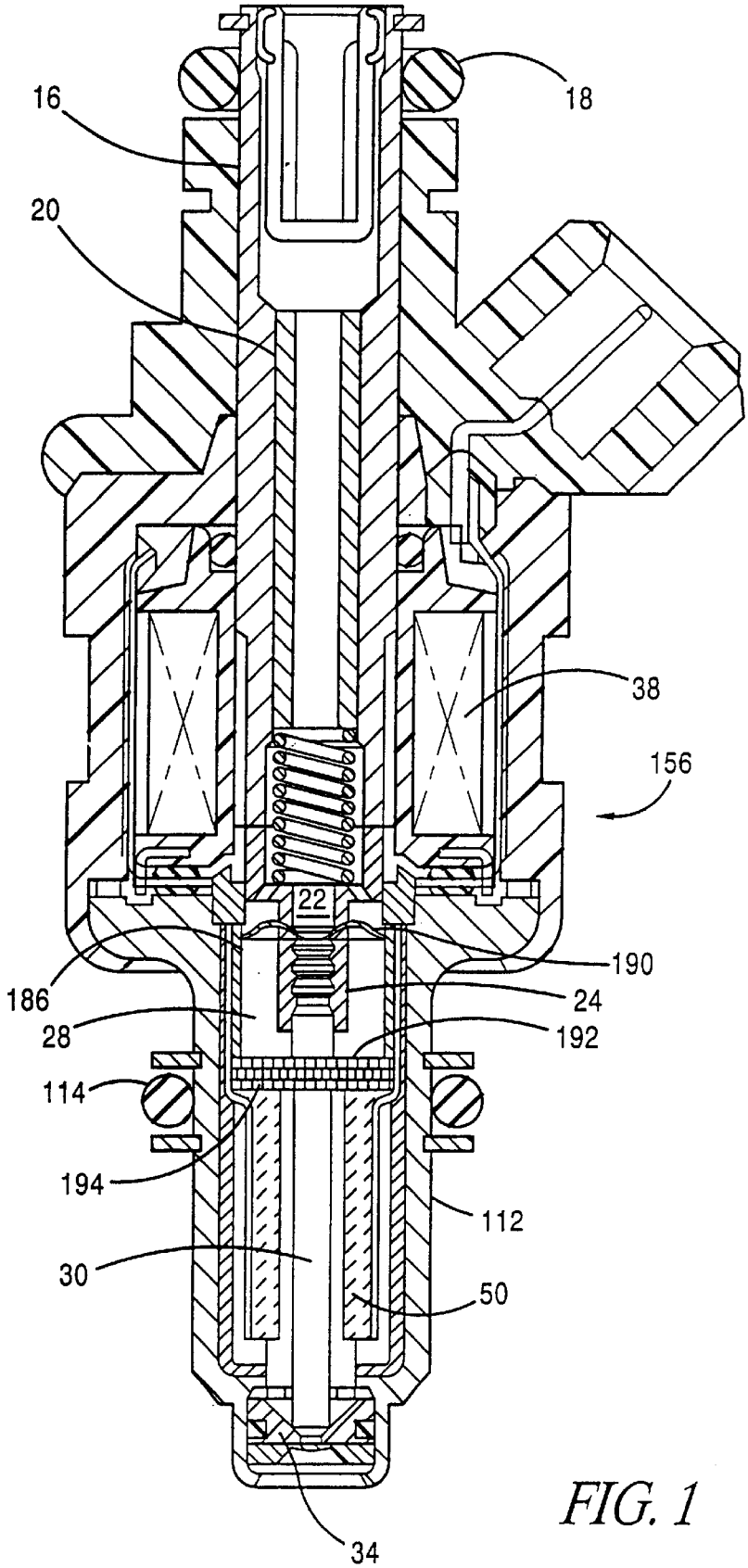
FIG. 1 is a longitudinal sectional view of a fuel injector.

FIG. 1 shows an exemplary fuel injector 156 to which the present invention may be applied. It should be understood that the present invention is applicable to fuel injectors having constructions other than the construction of the fuel injector 156 shown in FIG. 1.

Referring to FIG. 1, the fuel injector 156 includes a valve body or housing 112 for insertion into an injector seat of an intake manifold or cylinder is head of an engine (not shown). An O-ring 114 seals the housing 112 in the intake manifold or cylinder head. An inlet tube 16 at the upper end of the injector seats in a fuel rail (not shown) and an O-ring 18 seals the inlet tube 16 in the fuel rail. Fuel under pressure enters the inlet tube 16 and flows through the spring force adjusting tube 20, the bore 22 in the armature 24 and into a space 28 surrounding a needle valve 30 attached to the armature 24. The lower tip end of the needle valve is moved on and off a valve seat 34 to control outflow of fuel through an orifice in the valve seat 34. When energized, an electromagnetic coil 38 lifts the armature 24 off the valve seat 34.

An internal heater 50 is disposed in the bottom portion of the injector 156 above the seat 34. The heater 50 may be, for example, in the form of a hollow cylinder.

A flow-disturbing element 192 induces swirl and/or turbulence in the fuel prior to the fuel passing over the inner and outer surfaces of the heater 50. The swirl and/or turbulence induced in the fuel enhances heat transfer from the heater to the fuel. The flow-disturbing element may comprise stacked disks 194.

Figure 6:
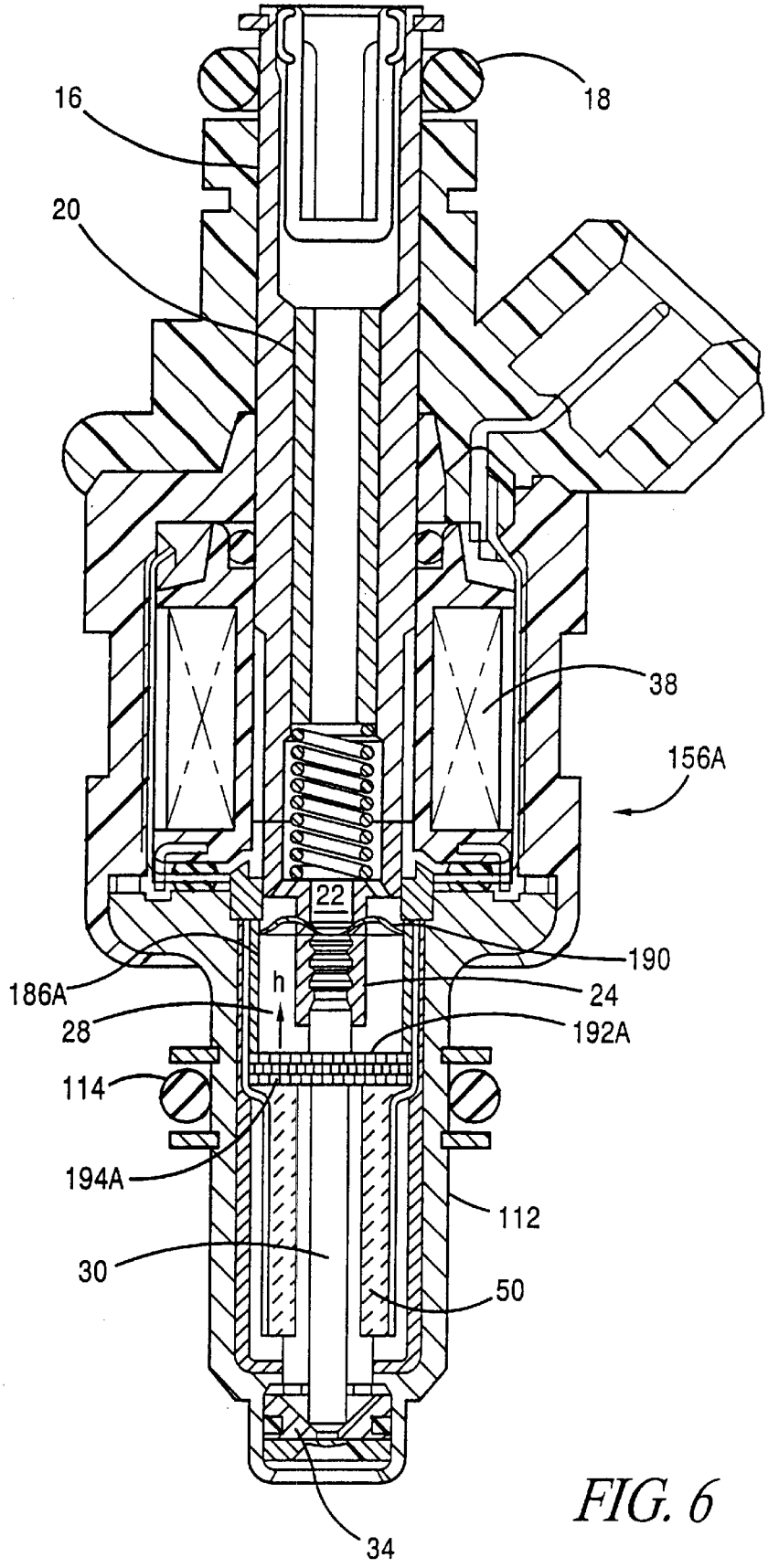
FIG. 6 is a longitudinal sectional view of a fuel injector according to the invention.

FIGS. 1 and 6 show flow disturbing elements 192, 192A, respectively. It should be understood that the flow disturbing elements 192, 192A represent generic flow disturbing elements and the flow disturbing elements 200 and 240 described in detail below may be substituted for the elements 192, 192A.

With reference to the exemplary embodiment of FIG. 1, the invention is a method of heating fuel comprising providing a fuel injector 156 having an internal heater 50 and a reciprocable needle valve 30; providing fuel to the fuel injector 156; passing the fuel through at least one flow disturbing element 192; and heating the fuel. The method further comprises exiting the fuel from the fuel injector through the opening in the seat 34. In the embodiment of FIG. 1, the flow-disturbing element 192 is stationary with respect to the needle valve 30.

FIGS. 2A–2C and 3 show a first embodiment 200 of the flow-disturbing element 192. The flow-disturbing element 200 is primarily designed to introduce turbulence into the fuel flow upstream of the heater 50. In its broadest aspect, the flow-disturbing element 200 comprises a plurality of disks each having at least one opening. The openings in the plurality of disks are offset from one another thereby providing a tortuous passageway through which the fuel must flow and, consequently, inducing turbulence into the fuel flow pattern.

The flow-disturbing element 200 shown in FIGS. 2A–2C and 3 comprises first, second and third disks 202, 204, 206. The second disk 204 has an opening 208, which extends substantially across the entire diameter of the disk 204. The opening 208 is preferably circular. The first and third disks 202, 206 each have a central opening 210, 212, respectively. The central openings 210, 212 are substantially the same size as a cross-section of the needle valve 30. The needle valve 30 is inserted through the central openings 210, 212 in the disks 202, 206 and through the opening 208 in the second disk 204. The disks 202, 206 may be attached to the needle valve 30 by, for example, welding. When so attached, the flow-disturbing element 200 reciprocates with the needle valve 30. Alternatively, the flow disturbing element 200 is not attached to the needle valve 30 and the flow disturbing element 200 remains stationary while the needle valve 30 reciprocates.

Figure 2A:
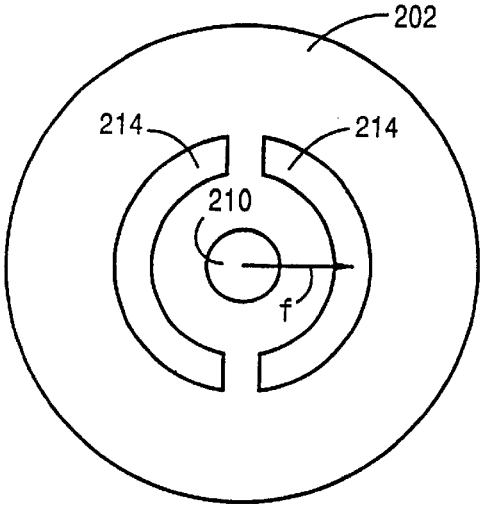
FIGS. 2A–2C are top views of heat transfer enhancing disks according to the present invention.
Figure 2B:
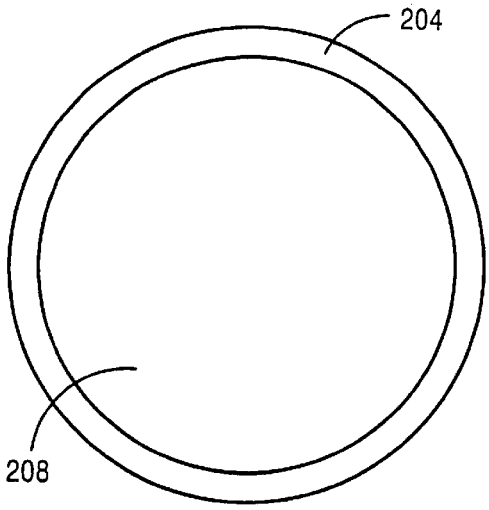
Figure 2C:
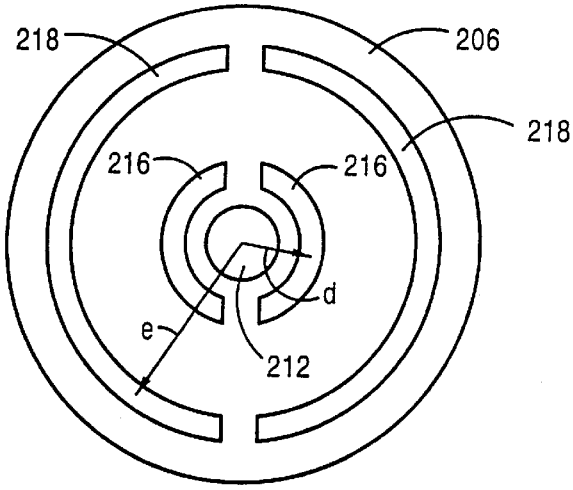
Figure 3:
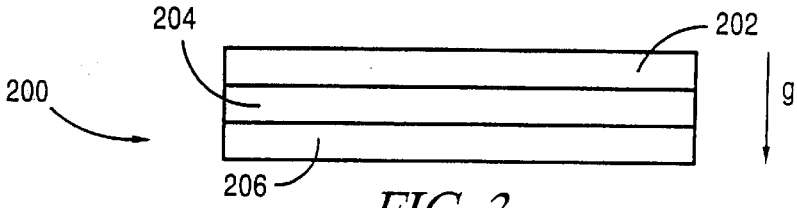
FIG. 3 is a schematic side view of the disks of FIGS. 2A–2C.

FIG. 3 is a schematic side view of the disks 202, 204, 206 shown in FIGS. 2A–2C. The arrow labeled g indicates the direction of flow of fuel. The fuel first encounters the first disk 202, then the second disk 204 and then the third disk 206. The three disks are stacked one on top the other and may be connected together by, for example, welding. The disks may be made of a metal such as stainless steel or a plastic material, which does not interact, with fuel. The flow-disturbing element 200 may also be made as a single piece. In that case, the flow-disturbing element would be either molded or machined.

The first disk 202 includes a pair of opposed openings 214. The third disk includes two pairs of opposed openings 216, 218. In FIG. 2A, the arrow f indicates the distance from the central opening of the first disk 202 to the opposed openings 214. In FIG. 2C, the arrow d indicates the distance from the central opening 212 to the opposed openings 216. The arrow e indicates the distance from the central opening 212 to the opposed openings 218. The distance d from the central opening 212 of the disk 206 to the opposed openings 216 is less than the distance f from the central opening 210 of the disk 202 to the opposed openings 214. Also, the distance e from the center of the disk 206 to the opposed openings 218 is greater than the distance f from the center of the disk 202 to the opposed openings 214.

In a preferred embodiment, the opposed openings 214, 216, 218 of the disks 202, 206 are spaced such that, when viewed in a longitudinal direction of the fuel injector, the openings 214 in the first disk 202 do not substantially overlap either the openings 216 or the openings 218 in the third disk 206. When there is no substantial overlap of the openings 214, 216, 218, a very tortuous pathway for the fuel is created thereby increasing the flow turbulence. Preferably, the openings 214, 216, 218 are semicircular in shape.

Referring now to FIG. 1, as the fuel enters the space 28 above the first embodiment 200 of the flow-disturbing element 192, the fuel contacts the first disk 202. The fuel flows through the openings 214 in the first disk 202, the opening 208 in the second disk 204 and then through the openings 216, 218 in the third disk 206. The disturbed flow which exits the third disk 206 then flows around the heater 50. Because of the increased turbulence in the fuel, the heat transfer from the heater 50 to the fuel is increased.

Broadly, the inventive method includes passing the fuel through a first opening 214 in the flow disturbing element 200 and then passing the fuel through a second opening 216 or 218 in the flow disturbing element 200 wherein the second opening 216 or 218 is offset from the first opening 214. Preferably, the inventive method includes passing the fuel through a first plurality of openings 214 in the flow disturbing element 200 and then passing the fuel through a second plurality of openings 216, 218 in the flow-disturbing element.

Most preferably, the first plurality of openings 214 are offset from the second plurality of openings 216, 218 such that, when viewed in a longitudinal direction of the injector, there is substantially no overlap between the first and second plurality of openings. The method includes passing the fuel through a first pair of opposed openings 214 in a first disk 202, through an opening 208 in a second disk 204, and then through second and third pairs of opposed openings 216, 218 in a third disk 206. The fuel flows around both an interior and exterior surface of the internal heater 50.

Figure 4A:
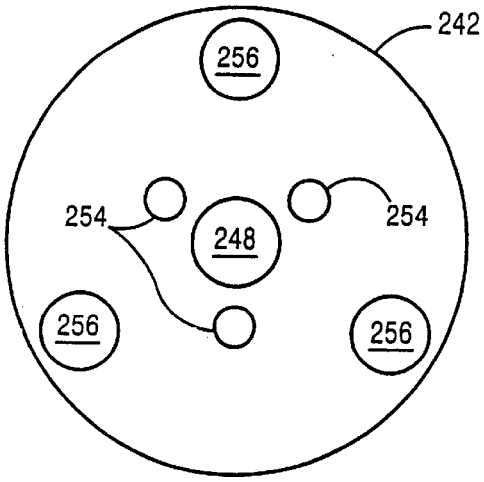
FIGS. 4A–4C are top views of heat transfer enhancing disks according to the present invention.
Figure 4B:
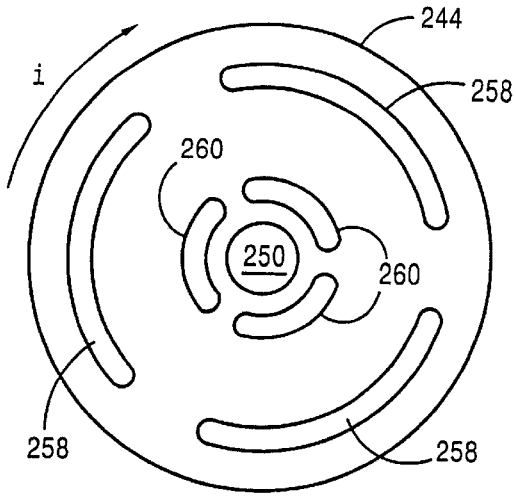
Figure 4C:
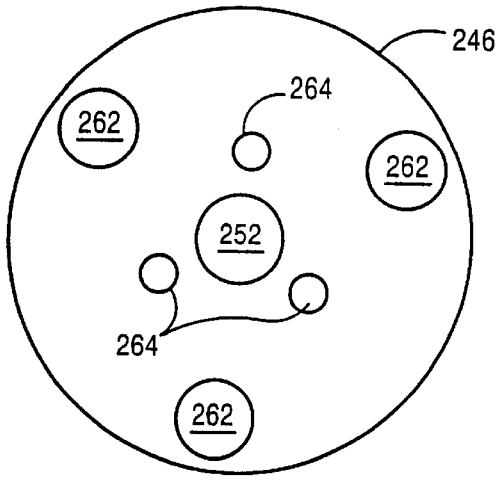
Figure 5:
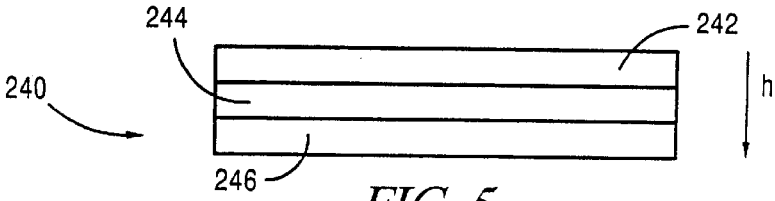
FIG. 5 is a schematic side view of the disks of FIGS. 4A–4C.

FIGS. 4A–4C and 5 show a second embodiment 240 of the flow-disturbing element 192. The flow-disturbing element 240 is designed to create swirl in the fuel flow by creating a circumferential flow component in the fuel. The flow-disturbing element 240 comprises three disks 242, 244, 246 stacked one on top the other as shown in FIG. 5. The arrow h in FIG. 5 indicates the direction of fuel flow through the flow-disturbing element 240. Each of the disks 242, 244, 246 has a central opening 248, 250, 252 for receiving the needle valve 30. The disks 242, 244, 246 may be attached to the needle valve 30 by, for example, welding. In that case, the flow-disturbing element 240 reciprocates with the needle valve 30. Alternatively, the flow-disturbing element 240 may not be attached to the needle valve in which case it would remain stationary when the needle valve reciprocates.

The disks 242, 244, 246 may be made of metal, for example, stainless steel or a plastic, which does not interact, with the fuel. The three disks may be attached to each other by, for example, welding. Alternatively, the flow-disturbing element 240 may be formed as a single piece. The disks may be molded or machined.

The first disk 242 includes a first plurality of openings 256 and a second plurality of openings 254. The first plurality of openings 256 are located further from the central opening 248 than the second plurality of openings 254. Preferably, each of the plurality of openings 256 is located substantially the same distance from the central opening 248. Likewise, each of the openings 254 is preferably located the same distance from the central opening 248. Most preferably, the openings 256 are about 120 degrees apart and the openings 254 are about 120 degrees apart.

The second disk 244 includes a first plurality of arc-shaped openings 258 and a second plurality of arc-shaped openings 260. The openings 258 are located further from the central opening 250 than the openings 260. Preferably, each of the openings 258 is located the same distance from the central opening 250 and each of the openings 260 is located the same distance from the central opening 250. Most preferably, the openings 258 are substantially identical in size and spaced substantially uniformly about the disk 244. Likewise, the openings 260 are preferably of the same size and spaced equally about the disk 244.

The third disk 246 includes a first plurality of openings 262 and a second plurality of openings 264. The openings 262 are located further from the central opening 252 than the openings 264. Preferably, each of the openings 262 is located the same distance from the central opening 252 and, likewise, each of the openings 264 is preferably located the same distance from the central opening 252. Most preferably, the openings 262 are about 120 degrees apart and the openings 264 are about 120 degrees apart.

When the disks 242, 244, 246 are stacked as shown in FIG. 5, each of the openings 256 is substantially located above one end of one of the arc-shaped openings 258. Likewise, each of the openings 254 is located substantially above one of the ends of one of the openings 260. The openings 262 in the disk 246 are located at opposite ends of the arc-shaped openings 258 than the openings 256 of the disk 242. Likewise, the openings 264 in the disk 246 are located substantially below opposite ends of the arc-shaped openings 260 than the openings 254 in the disks 242.

With the above-described alignment of the disks, six fuel flow channels are created. For example, fuel will enter an opening 256 in the disk 242, then flow through an arc-shaped opening 258 and exit through an opening 262 in the disk 246. Likewise, fuel will enter an opening 254 in the disk 242 and then flow through an arc-shaped opening 260 and exit through an opening 264 in disk 246. The flow, which exits the openings 262 and 264, includes a swirl component. The fuel will swirl around the heater 50, thereby enhancing heat transfer from the heater 50 to the fuel.

Preferably, the flow directions through the arc-shaped openings 258 and 260 are opposite. For example, as shown in FIG. 4B, if the flow through the arc-shaped openings 258 is in the direction shown by the letter i, then the flow in the arc-shaped openings 260 would be in a direction opposite the arrow i. Alternatively, the flow in the openings 260 could be in the direction i and the flow in the openings 258 could be in a direction opposite the arrow i. Most preferably, the openings 256, 254 in disk 242 and the openings 262, 264 in disk 246 are substantially circular in shape. FIGS. 4A–4C show three openings 256, three openings 254, three arc-shaped openings 258, three arc-shaped openings 260, three openings 262 and three openings 264. However, the number of each of the openings could be more or less than three.

Referring back to the exemplary fuel injector 156 of FIG. 1, the flow disturbing element 192 is located between the heater 50 and a spacer sleeve 186 which is held in place by a spring washer 190. In the injector 156, the flow-disturbing element 192 (or 200 or 240) is not attached to the needle valve 30. That is, as the needle valve 30 reciprocates, the flow-disturbing element 192 remains stationary. In FIG. 1, the flow-disturbing element 192 rests substantially on top of the internal heater 50. Alternatively, a gap may exist between the top of the heater 50 and the stationary flow-disturbing element 192. In that case, a portion of the spacer sleeve 186 would be located below the element 192 and above the heater 50 to create the gap.

FIG. 6 is a longitudinal sectional view of a fuel injector 156A according to the present invention. In FIGS. 1 and 6, like reference numerals refer to like features. In the fuel injector 156A of FIG. 6, the spacer sleeve 186A extends from the spring washer 190 to the heater 50. The flow disturbing element 192A (or 200 or 240) is attached to the needle valve 30. Therefore, when the needle valve 30 reciprocates, the flow-disturbing element 192A likewise reciprocates.

As shown by the arrow h in FIG. 6, the flow disturbing element 192A may be attached to any part of the needle valve 30 along the arrow h. Therefore, when the needle valve 30 is closed, a gap may exist between the bottom of the flow disturbing element 192A and the top of the heater 50. By mounting the flow disturbing element 192A higher on the needle valve 30 and creating a gap between the flow disturbing element 192A and the heater 50, the turbulence or swirl created in the fuel develops more fully before the fuel contacts the heater 50. Thus, a gap between the flow disturbing element 192A and the heater 50 is advantageous because the increased turbulence or swirl additionally enhances the heat transfer between the heater 50 and the fuel.

While the invention has been described with reference to certain preferred embodiments, numerous changes, modifications and alterations to the described embodiments are possible without departing from the spirit and scope of the invention, as described in the appended claims and equivalents thereof.

What is claimed is:

1. A method of heating fuel comprising the following steps in the order named:

providing a fuel injector having an internal heater and a reciprocable needle valve;

providing fuel to the fuel injector;

passing the fuel through at least one flow disturbing element, the passing step including passing the fuel through a first plurality of openings in the flow disturbing element and then passing the fuel through a second plurality of openings in the flow disturbing element, wherein the first plurality of openings are offset from the second plurality of openings such that, when viewed in a longitudinal direction to the injector, there is substantially no overlap between the first and second plurality of openings; and heating the fuel.

2. The method of claim 1 wherein the passing step includes passing the fuel through a first pair of opposed openings in a first disk, through an opening in a second disk, and then through second and third pairs of opposed openings in a third disk.

3. The method of claim 2 wherein, when viewed in a longitudinal direction of the fuel injector, the first pair of opposed openings in the first disk do not substantially overlap the second and third pair of opposed openings in the third disk.

4. The method of claim 3 further comprising passing the fuel around both an interior and exterior surface of the internal heater.

5. A method of heating fuel comprising the following steps in the order named:

providing a fuel injector having an internal heater and a reciprocable needle valve;

providing fuel to the fuel injector;

passing the fuel through at least one flow disturbing element, the passing step including creating a swirl flow component in the fuel, wherein the creating the swirl flow component includes creating a circumferential flow component in the fuel including directing the fuel through at least one arc-shaped opening in the flow disturbing element; and heating the fuel.

6. The method of claim 5 wherein creating a circumferential flow component in the fuel includes directing the fuel through six arc-shaped openings in the flow disturbing element.

7. The method of claim 6 wherein directing the fuel includes directing the fuel in one direction through three of the arc-shaped openings and directing the fuel in an opposite direction through the other three of the arc-shaped openings.

8. The method of claim 7 wherein the three arc-shaped openings are substantially equal in size and spaced substantially uniformly in the flow disturbing element and the other three arc-shaped openings are substantially equal in size and spaced substantially uniformly in the flow disturbing element.

9. The method of claim 8 wherein the three arc-shaped openings are located further from a center of the flow disturbing element than the other three arc-shaped openings.

10. A method of heating fuel comprising the following steps in the order named:

providing a fuel injector having an internal heater and a reciprocable needle valve;

providing fuel to the fuel injector;

passing the fuel through at least one flow disturbing element, the at least one fuel disturbing element reciprocating with the needle valve; and heating the fuel;

wherein when the needle valve reciprocates to a closed position the flow-disturbing element rests substantially on a top of the internal heater.

11. The method of claim 10 wherein the at least one flow disturbing element is stationary with respect to the needle valve.

12. The method of claim 10 wherein the passing step includes passing the fuel through a first opening in the flow disturbing element and then passing the fuel through a second opening in the flow disturbing element wherein the second opening is offset from the first opening.

13. The method of claim 11 wherein when the needle valve reciprocates to a closed position the flow-disturbing element rests substantially on a top of the internal heater.

14. The method of claim 11 wherein when the needle valve reciprocates to a closed position there is a gap between the flow disturbing element and a top of the internal heater.

15. A method of heating fuel comprising the following steps in the order named:

providing a fuel injector having an internal heater and a reciprocable needle valve;

providing fuel to the fuel injector;

passing the fuel through at least one flow disturbing element, the at least one fuel disturbing element reciprocating with the needle valve; and heating the fuel;

wherein when the needle valve reciprocates to a closed position there is a gap between the flow disturbing element and a top of the internal heater.

16. The method of claim 15 wherein the at least one flow disturbing element is stationary with respect to the needle valve.

17. The method of claim 16 wherein when the needle valve reciprocates to a closed position the flow-disturbing element rests substantially on a top of the internal heater.

18. The method of claim 16 wherein when the needle valve reciprocates to a closed position there is a gap between the flow disturbing element and a top of the internal heater.

19. The method of claim 15 wherein the passing step includes passing the fuel through a first opening in the flow disturbing element and then passing the fuel through a second opening in the flow disturbing element wherein the second opening is offset from the first opening.

* * * * *